US009532860B2

(12) United States Patent
Gil Pascual

(10) Patent No.: US 9,532,860 B2
(45) Date of Patent: Jan. 3, 2017

(54) CONTAINER BAG FOR CONTAINING SEMEN FOR ARTIFICIAL INSEMINATION OF ANIMALS

(75) Inventor: Javier Gil Pascual, Centelles (ES)

(73) Assignee: TECNOVET. S.L., Barcelona (ES)

( * ) Notice: Subject to any disclaimer, the term of this patent is extended or adjusted under 35 U.S.C. 154(b) by 151 days.

(21) Appl. No.: 14/404,620

(22) PCT Filed: May 30, 2012

(86) PCT No.: PCT/ES2012/070401

§ 371 (c)(1),
(2), (4) Date: Jan. 15, 2015

(87) PCT Pub. No.: WO2013/178833

PCT Pub. Date: Dec. 5, 2013

(65) Prior Publication Data

US 2015/0141744 A1 May 21, 2015

(51) Int. Cl.

| | |
|---|---|
| ***A61D 19/02*** | (2006.01) |
| ***A61J 1/10*** | (2006.01) |
| ***A61J 1/14*** | (2006.01) |

(52) U.S. Cl.

CPC ..... *A61D 19/024* (2013.01); *A61D 19/022* (2013.01); *A61J 1/10* (2013.01); *A61J 1/1412* (2013.01)

(58) Field of Classification Search

CPC ..... A61D 19/02; A61D 19/21; A61D 19/022; A61D 19/024; A61J 1/10; A61J 1/1412

USPC ..... 600/33–35; 604/403–416; 383/121

See application file for complete search history.

(56) References Cited

U.S. PATENT DOCUMENTS

| | | | | |
|---|---|---|---|---|
| 7,150,734 | B2 * | 12/2006 | Lecointe | A61D 19/022 383/38 |
| 8,506,164 | B2 * | 8/2013 | Lecointe | A61J 1/06 383/22 |
| 2010/0263370 | A1 * | 10/2010 | Wu | F15B 15/10 60/602 |

FOREIGN PATENT DOCUMENTS

| | | |
|---|---|---|
| EP | 2149348 | 2/2010 |
| ES | 2247888 | 3/2006 |
| ES | 2249544 | 4/2006 |
| ES | 2263658 | 12/2006 |
| FR | 2820029 | 8/2002 |

OTHER PUBLICATIONS

International Search Report for PCT/ES2012/070401 dated Nov. 27, 2012.

(Continued)

*Primary Examiner* — John Lacyk

(74) *Attorney, Agent, or Firm* — Gottlieb, Rackman & Reisman, P.C.

(57) ABSTRACT

The present invention relates to a container bag (1) for containing semen for artificial insemination of animals, of the types which are formed by at least two sheets (2.1, 2.2) of sealed thermoplastic material, forming a tubular body (3) with an inner hollow (4) divided by means of a central constriction (5) into first and second contiguous enclosures (7.1, 7.2) communicated by means of a cannula (6) secured in said constriction (5), which bag comprises a closure plug (10) for closing said cannula (6) secured to the bottom (13) of the second enclosure (7.2) of the inner hollow (4), means for securing the cannula (6) to the central constriction (5), and means for securing the closure plug (10) to the bottom (13) of the second enclosure (7.2).

6 Claims, 4 Drawing Sheets

(56) References Cited

OTHER PUBLICATIONS

European Search Report dated Feb. 23, 2016 for Corresponding Application EP 12877700 Based on PCT/ES2012/070401 filed May 30, 2012.
Written Opinion of the International Preliminary Examining Authority Issued for PCT/ES2012/070401 Dated May 12, 2014.

* cited by examiner

CONTAINER BAG FOR CONTAINING SEMEN FOR ARTIFICIAL INSEMINATION OF ANIMALS

TECHNICAL FIELD OF THE INVENTION

The present invention corresponds to the technical field of artificial insemination of animals and of the devices necessary for such practice.

BACKGROUND OF THE INVENTION

The technique for artificial insemination of animals by means of vaginally introducing a dose of semen into a female in heat is widely used today. A catheter and sometimes, depending on the specific insemination point, a cannula fixed thereto must be used to reach the vagina of the animal.

The catheter usually has a handle at the end which remains outside the animal facilitating handling as well as the connection of said catheter to the container bag for containing semen. This bag usually has a cannula in the semen outlet hole to favor said connection between the catheter and the container bag.

A large variety of container bags for containing semen for artificial insemination of animals can be found in the state of the art. Some of them have one and the same semen inlet and outlet hole. These cases have the drawback that the hole through which the semen is first introduced undergoes certain deformations due to the introduction of the filling nozzle therein, such that the connection of the catheter in said semen outlet hole then becomes defective, a proper securing thereof not being achieved.

Container bags for containing semen with a semen inlet hole and another semen outlet hole solving this problem are also found in the state of the art. This case has the drawback that after insemination, some stagnant semen remains in the conduit of the cannula existing in the outlet hole for the connection of the catheter therein, where the spermatozoids eventually die. These dead spermatozoids form a barrier in subsequent inseminations, reducing process effectiveness.

Reference documents US2003163110, FR2820029 and ES2247888-A1 can be mentioned as examples of the state of the art.

The first reference document US2003163110 relates to a bag for packaging semen formed by two plastic walls joined in such a manner as to delimit a pouch for receiving the semen. It has an evacuation conduit the end part of which is closed by said joined walls when the bag is closed. Said conduit comprises a cannula having two open ends force-fitted therein, its first end being suitable for communicating with said pouch, whereas its second end located close to the end part of the conduit has a frustoconical- or almost frustoconical-shaped constriction. Said conduit further communicates, over a fraction of its length, with at least one area located not far from the end part in which the two walls are not joined.

In the second reference document FR2820029, the container bag for containing semen is formed by two plastic walls joined so as to define a pouch for receiving said substance. Said pouch has communicated therewith an evacuation conduit the end part of which has a cannula with two open ends when the bag has not been opened. This cannula is inserted into conduit, such that its first end is capable of communicating with said pouch, whereas the second end is located close to the end part of the conduit.

The cannula in turn comprises at its second end a blind end finish which is physically separated or separable when the bag is closed. The joined walls surround the cannula and its blind end in a leak-tight manner, so when a force is applied on the blind end in a direction perpendicular to the plane of the bag, one of the plastic walls tears at the level of the second end of the cannula, said cannula being directly accessible.

The applicant is the proprietor of the mentioned third reference document ES2247888-A1. In this case, it relates to a device for artificial insemination of animals having a bag made up of at least two sheets of thermoplastic material sealed through a perimetral structure, such that a receptacle containing the semen is defined communicating with the outside through an inlet hole and an outlet hole.

A cannula having a certain thickness is tightly fitted in the outlet hole, part of the cannula being outside the bag and the cannula having a plug for closing the outer part thereof. Said plug comprises a stem integral with the head of the plug, such that when the plug is placed in the outer part of the cannula, the stem is tightly fitted at least along the entire length of the cannula.

In the case of the first two mentioned documents of the state of the art, it can be observed how the cannula existing in the outlet hole of the container bag has no plug, whereby the main drawback is that performing more than one dose of insemination is difficult.

Specifically, the cannula in the first reference document US2003163110 has no plug at all, rather its second end is close to the end part of the outlet conduit and the section thereof has a constriction at said frustoconical-shaped end. This makes the application of successive doses with the same bag difficult and in the event of doing so, there would be a high risk of unwanted semen spillage as well as the entry of hazardous elements or contaminants into the bag.

The cannula in the second reference document FR2820029 also has no closure plug, but rather a blind end finish which seals the bag when the bag is closed and which must be removed or broken to be able to open the cannula. This facilitates tearing open the bag, but it also has the drawback of complicating the application of new doses of semen with such bag without the risk of unwanted spillage and of possible contaminations due to the entry of hazardous elements into the bag.

If the blind end finish is not broken but rather removed, said end finish could be returned to that position for closing the cannula, but in that case the drawback is that semen accumulates inside the conduit of the cannula which remains leak-tight, whereby the spermatozoids die and are a barrier in subsequent inseminations for the advancing spermatozoids remaining in the bag, significantly reducing process effectiveness.

It is observed in the third reference document ES2247888-A1 that a solution to these problems is provided by means of a closure plug closing the outer part of the cannula, having a stem tightly fitted therein along the entire length of the cannula. This enables applying several doses of insemination without spillage or possible contamination problems, while at the same time preventing stagnant semen from remaining inside the cannula since the plug is located therein.

Nevertheless, this solution continues to pose certain drawbacks such as the fact that when opening the bag, the closure plug for closing the cannula falls to the ground where the liquid manure of the animals is located, whereby said plug is not reusable since it would contaminate the bag with hazardous agents.

Although this can be solved by using a new plug, in addition to the continuous need for providing new plugs, there is a problem where the disposed plugs are collected together with the liquid manure subsequently used as soil fertilizer. The problem is that the plugs are also disposed of along with the liquid manure and the soil is ultimately contaminated.

Another drawback present in all the solutions of the state of the art is that the current manufacture of such container bags uses two sheets of plastic material welded to one another, in which the outlet cannula has been previously introduced between them. The outlet cannula is thicker than the sheet of plastic material and it must be made in a plastic material that does not deform under welding heat, so the cannula is secured to the sheets more by pressure than by heat fusion. This means that the weld with the bag is not a high quality weld, such that most of the times the outlet cannula sinks into the bag in response to the pressure exerted on said outlet cannula when the insemination catheter is placed therein.

DESCRIPTION OF THE INVENTION

The container bag for containing semen for artificial insemination of animals proposed herein, of the types which are formed by at least two sheets of sealed thermoplastic material, forming a tubular body with an inner hollow perimetrically closed except at at least one of its ends and divided by means of a central constriction into first and second contiguous enclosures communicated by means of a cannula secured in said constriction, comprises a closure plug for closing the cannula secured to the bottom of the second enclosure of the inner hollow and means for securing said closure plug to the bottom of the second enclosure.

Likewise, the invention comprises means for securing the cannula to the central constriction.

The cannula which is secured to the constriction is formed by a tube comprising a flattened head at a first end thereof. The means for securing this cannula to the central constriction of the bag can be formed by welding the head of the cannula to said constriction. With the flattened head of the bag, the section of which is considerably smaller at its ends, a perfect welding thereof to the constriction of the bag is achieved, whereby immobilizing the cannula with respect to same.

The closure plug for closing the cannula in turn comprises a flexible longitudinal body that can be tightly fitted into the cannula and a head outside same in which the closure plug is secured to the bottom of the second enclosure.

The means for securing the plug to the bottom of the second enclosure can be formed by welding the head of the plug to the surface of the bottom of this second enclosure of the inner hollow.

In this container bag, the second enclosure is sized to favor an effective and easy connection of the insemination catheter to the outlet cannula.

This bag can in turn comprise means for separating the two sealed sheets of thermoplastic material at at least one of its non-perimetrically closed ends.

Likewise, the invention comprises means for opening the bag through a section of the second enclosure. These means can be formed by a pre-cut line in said section of the second enclosure and a hole limiting said section.

The cannula in turn has a length such that the second end of the tube forming the cannula protrudes from said pre-cut line of the section of the second enclosure.

This container bag for containing semen is presented in series in a succession of bags, these being attached to one another by means of pre-cut lines which separate heat-sealing areas of contiguous bags.

A significant improvement of the state of the art is achieved with the container bag for containing semen for artificial insemination of animals presented herein.

This is because, as a result of the closure plug secured to the bottom of the second enclosure of the inner hollow of the bag, when the bag is opened through a section of said second enclosure, the plug secured thereto is removed from inside the cannula leaving it free for the passage of semen, the plug remaining secured to the bag at the same time, whereby it does not contact any external element which may contaminate it.

Therefore, the closure plug is reusable by introducing it again in the cannula after insemination to preserve the content of the bag from possible contaminations until a new insemination is performed, for which the plug which is again secured to the bag is removed once more.

Furthermore, this prevents the closure plug from being left on the ground as waste along with the liquid manure of the animals and from being able to contaminate the soil when this liquid manure is subsequently disposed of together with the plugs as soil fertilizer.

Likewise, the fact that the cannula is formed by a tube with a flattened head facilitates welding same to the bag in the area of the constriction and therefore assures a perfect fixing of the cannula, without possible movements with respect to the bag as well as sinking therein due to the pressure of connecting the insemination catheter.

The sealed cannula and plug thus assure leak-tightness and sanitary cleanliness, and therefore the insemination process, which becomes much more effective.

Furthermore, as a result of the fact that the second end of the tube of the cannula protrudes from the pre-cut line of a section of the second enclosure, the connection between the cannula and the insemination catheter is improved since the conditions in which the connection is made are facilitated.

Likewise, since the closure plug has a longitudinal body that can be tightly fitted into the cannula, it assures that there is no semen remaining therein, whereby favoring the effectiveness of subsequent inseminations.

BRIEF DESCRIPTION OF THE DRAWINGS

For the purpose of aiding to better understand the features of the invention according to a preferred practical embodiment thereof, a set of drawings is provided as an integral part of said description in which the following has been depicted with an illustrative and non-limiting character.

DETAILED DESCRIPTION OF A PREFERRED EMBODIMENT OF THE INVENTION

Figure 1:
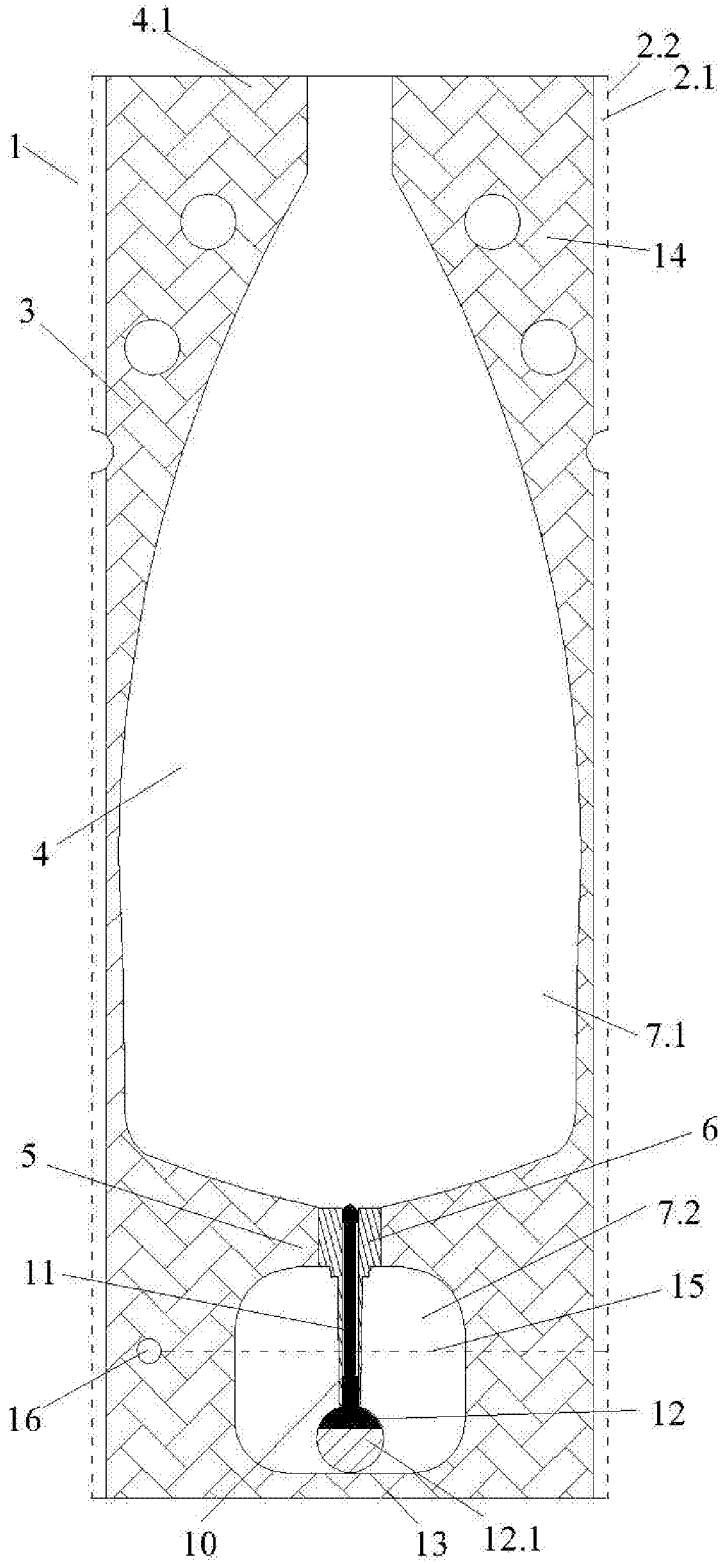
FIG. 1 shows a cross-section view of the bag in a closed position.

In view of the provided drawings, it can be observed how in a preferred embodiment of the invention, the container bag 1 for containing semen for artificial insemination of animals presented herein, of the types which are formed by at least two sealed sheets 2.1, 2.2, of thermoplastic material, forming a tubular body 3 with an inner hollow 4 perimetrically closed except at at least one of its ends 4.1 and this inner hollow 4 being divided by means of a central constriction 5 into a first contiguous enclosure 7.1 and a second contiguous enclosure 7.2 which are communicated by means of a cannula 6 secured to said constriction 5, comprises a closure plug 10 for closing said cannula 6 secured to the bottom 13 of the second enclosure 7.2 of the inner hollow 4 and means for securing said closure plug 10 to the bottom 13 of said second enclosure 7.2.

This bag in turn comprises means for securing the cannula 6 to the central constriction 5.

Figure 4:
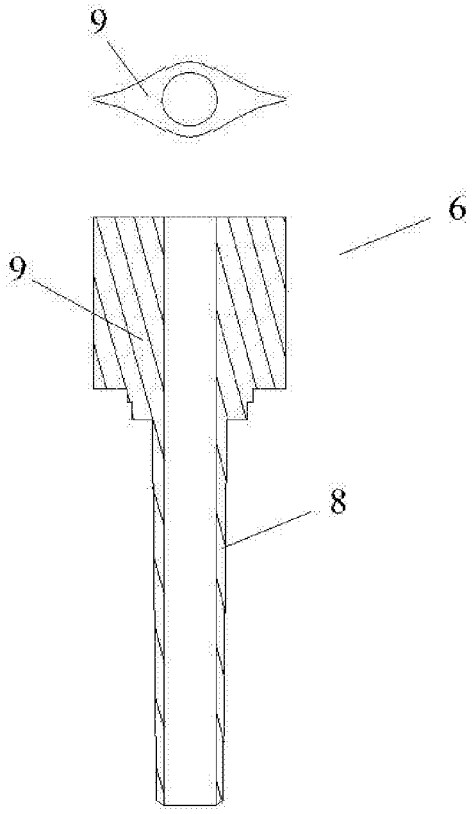
FIG. 4 shows a plan and cross-section views of the cannula.

In this preferred embodiment of the invention, as shown in FIG. 4, the cannula 6 comprises a tube 8 which has a flattened head 9 at a first end 8.1. Likewise, the means for securing the cannula 6 to the constriction 5 are formed by welding the head 9 to said constriction 5.

As a result of the flattened head 9 of the cannula 6, the section of which is considerably smaller at the ends, a perfect welding to the constriction 5 is favored, whereby the proper securing and leak-tightness thereof is assured.

Figure 2:
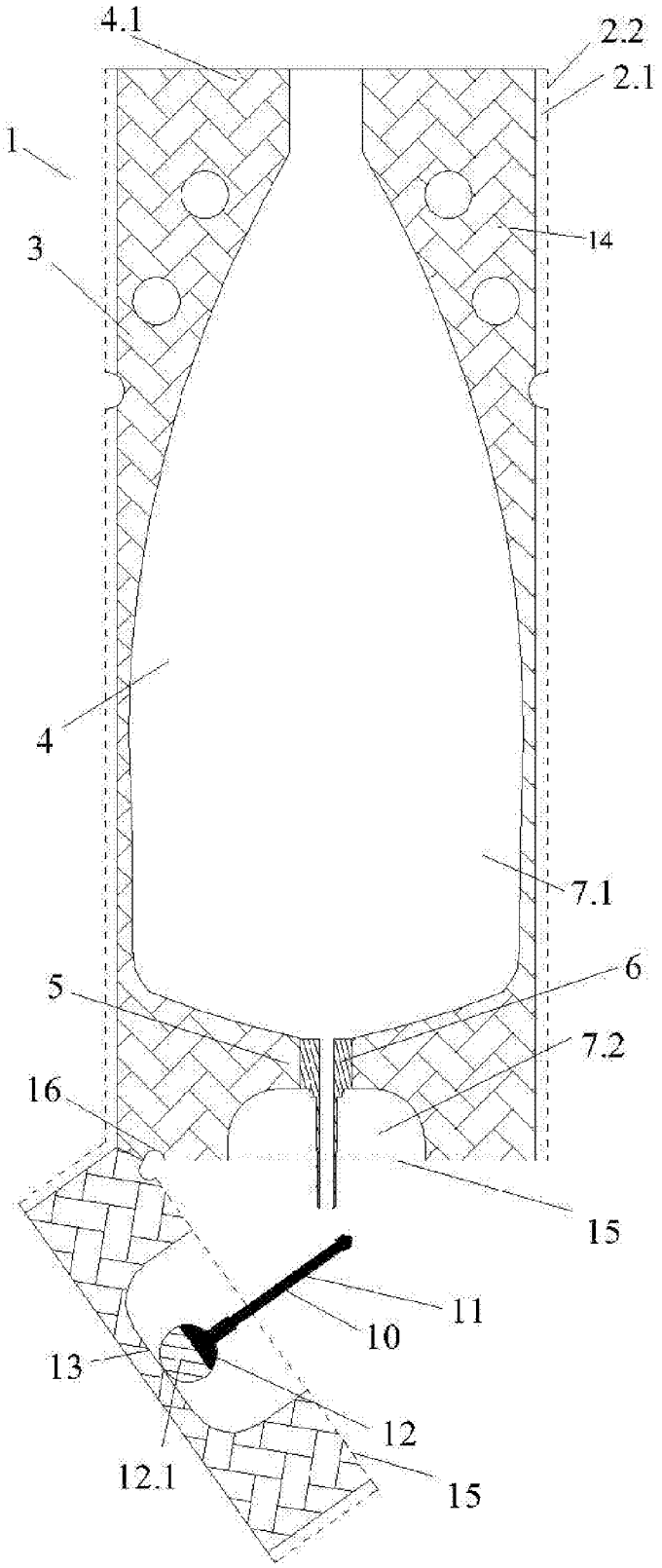
FIG. 2 shows a cross-section view of the bag in an open position.

As can be observed in FIGS. 1 and 2, the closure plug 10 of this container bag comprises a flexible longitudinal body 11 that can be tightly fitted into the cannula 6 and a head 12 outside same where said closure plug 10 is secured to the bottom of the second enclosure 7.2.

The container bag 1 for containing semen in turn comprises means for securing the closure plug 10 to the bottom 13 of the second enclosure 7.2, which in this preferred embodiment of the invention are formed by welding part 12.1 of the head 12 of the closure plug 10 to the bottom 13 of said second enclosure 7.2.

Said second enclosure 7.2 is sized such that it favors connecting the insemination catheter and the outlet cannula in an easy and loose-fitting manner.

On the other hand, the bag 1 in turn comprises means for opening it through a section of the second enclosure 7.2, which in this preferred embodiment of the invention are formed by a pre-cut line 15 along said section and a hole 16 limiting same.

In turn, the cannula 6 secured to the constriction 5 is of a length such that the second end 8.2 of the tube 8 forming the cannula protrudes from the pre-cut line 15 existing in the section of the second enclosure 7.2.

Figure 3:
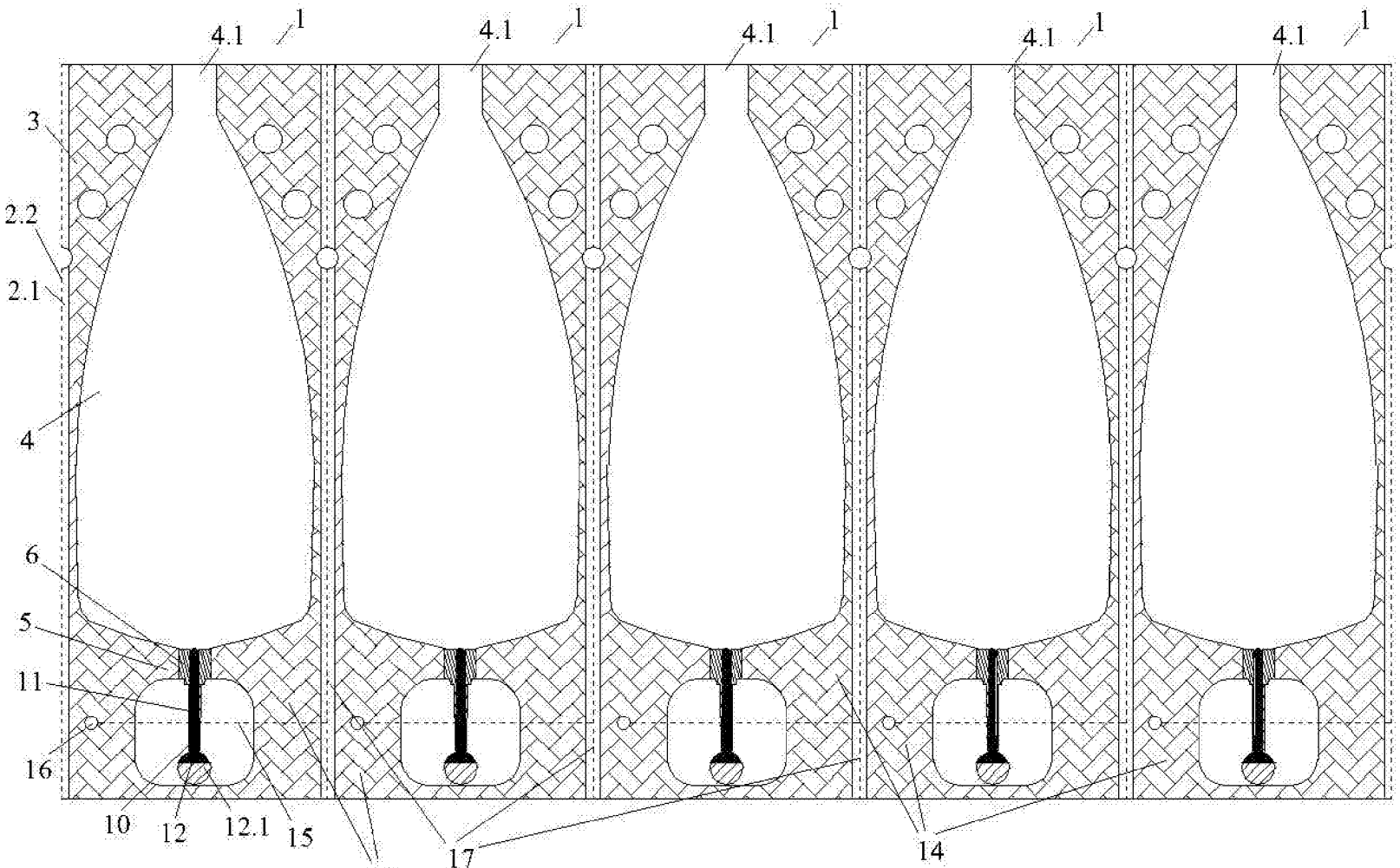
FIG. 3 shows a cross-section view of the presentation of these bags in series.

As shown in FIG. 3, this bag 1 is presented in series where each one of the bags 1 is attached to the two adjacent bags by means of pre-cut lines 17 separating heat-sealing areas 14 of contiguous bags.

The drawbacks existing in the state of the art are successfully solved with the container bag for containing semen for artificial insemination of animals presented herein.

Therefore, as a result of a closure plug for closing the cannula secured to the lower part of the bag, specifically to the base of the second enclosure of the inner hollow, said plug does not come loose and fall after opening the bag.

Hence, it does not come into contact with external agents and therefore continues to be in perfect conditions to be reused and to again close the bag with it, which bag is thus protected against possible spillage or the entry of hazardous elements therein and being kept in perfect conditions to apply new doses of insemination.

Furthermore, the shape of the closure plug assures that no stagnant semen residues remain inside the cannula, preventing the formation of a barrier of dead spermatozoids, whereby higher process effectiveness is achieved for applying the subsequent doses of semen.

Likewise, soil contamination is prevented because since the plug does not fall onto the liquid manure, when the liquid manure is collected to be reused as fertilizer, said plugs are not included therein, the contamination of the soil where said liquid manure is disposed of thus being prevented.

On the other hand, a perfect fixing of the cannula to the constriction of the bag is obtained, assuring that the cannula does not move with respect to said bag and that the cannula does not sink into the bag due to the pressure of connecting the insemination catheter. This is obtained as a result of the shape of the head of the cannula favoring a perfect welding of same to said constriction.

Likewise, as a result of the length of the cannula causing the second end of the tube forming it to protrude from the pre-cut line of the second enclosure, when the bag is opened, the cannula protrudes from the cut made and the conditions for connecting said cannula and the insemination catheter are thereby improved.

Furthermore, the sealing of the cannula and of the plug, respectively, creates leak-tightness and favors keeping the sanitary cleanliness of both elements, this being very favorable for the insemination process.

The invention claimed is:

1. Container bag for containing semen for artificial insemination of animals being formed by at least two sealed sheets of thermoplastic material, forming a tubular body with an inner hollow perimetrically closed except at at least one of its ends and divided by means of a central constriction into first and second contiguous enclosures communicated by means of a cannula secured in said constriction, the container bag comprising:

a closure plug for closing said cannula secured to the bottom of the second enclosure of the inner hollow;

means for securing the cannula to the central constriction, and;

means for securing the closure plug to the bottom of the second enclosure, wherein the closure plug for closing the cannula comprises a flexible longitudinal body that can be tightly fitted in the cannula, and a head outside same, whereby the closure plug is secured to the bottom of the second enclosure and further including means for opening the bag through section of the second enclosure, the means for opening the bag comprising a pre-cut line in a section of the second enclosure and a hole limiting said section.

2. Container bag for containing semen for artificial insemination of animals according to claim 1, wherein the cannula is formed by a tube comprising a flattened head at a first end.

3. Container bag for containing semen for artificial insemination of animals according to claim 2, wherein the means for securing the cannula to the central constriction are formed by welding the head of the cannula to the bag in said central constriction.

4. Container bag for containing semen for artificial insemination of animals according to claim 1, further comprising means for separating the two sealed sheets of thermoplastic material at the at least one of its non-perimetrically closed ends.

5. Container bag for containing semen for artificial insemination of animals according to claim 1, wherein the cannula is of a length such that the second end of the tube forming the cannula protrudes from the pre-cut line of the section of the second enclosure.

6. A series of container bags according to claim 1, wherein the bags are presented in series, attached to one another by means of pre-cut lines which separate heat-sealing areas of contiguous bags.

* * * * *